US010912338B2

(12) United States Patent
Yan et al.

(10) Patent No.: US 10,912,338 B2
(45) Date of Patent: Feb. 9, 2021

(54) ELECTRONIC CIGARETTE AND USING METHOD TO ACCURATELY DETERMINE AN AMOUNT OF A TOBACCO LIQUID IN A LIUID STORAGE CHAMBER

(71) Applicant: Shenzhen First Union Technology Co., Ltd., Shenzhen (CN)

(72) Inventors: Huiyong Yan, Shenzhen (CN); Huidong Wu, Shenzhen (CN); Yonghai Li, Shenzhen (CN); Zhongli Xu, Shenzhen (CN)

(73) Assignee: Shenzhen First Union Technology Co., Ltd., Guangdong (CN)

( * ) Notice: Subject to any disclaimer, the term of this patent is extended or adjusted under 35 U.S.C. 154(b) by 343 days.

(21) Appl. No.: 15/990,541

(22) Filed: May 25, 2018

(65) Prior Publication Data

US 2018/0338537 A1 Nov. 29, 2018

(30) Foreign Application Priority Data

May 27, 2017 (CN) ..... 2017 1 0391123

(51) Int. Cl.
*A24F 13/00* (2006.01)
*A24F 17/00* (2006.01)
(Continued)

(52) U.S. Cl.
CPC ..... *A24F 47/008* (2013.01); *H05B 1/0283* (2013.01)

(58) Field of Classification Search
CPC ..... A24F 40/10; A24F 40/51; A24F 47/008; A24F 47/002; A24F 40/42
(Continued)

(56) References Cited

U.S. PATENT DOCUMENTS

2015/0128966 A1* 5/2015 Lord ..... A24F 47/002 131/328
2017/0231276 A1* 8/2017 Mironov ..... A24F 47/008 131/328
(Continued)

FOREIGN PATENT DOCUMENTS

WO 20150151053 A2 10/2015
WO 20160101248 A1 6/2016
(Continued)

*Primary Examiner* — Hae Moon Hyeon
(74) *Attorney, Agent, or Firm* — PROI Intellectual Property US; Klaus Michael Schmid

(57) ABSTRACT

An electronic cigarette includes: an atomizer, defining a liquid storage chamber formed therein; a heating element, communicated with the liquid storage chamber; a power supply, configured for supplying power; a controlling unit, one end of the controlling unit electrically connected with the power supply, the other end thereof electrically connected with the heating element; and a capacitive transducer electrically connected with the controlling unit. Two electrodes are disposed inside the liquid storage chamber for determining an amount of the tobacco liquid in the liquid storage chamber. A using method includes: conducting the electricity and controlling the heating element to atomize the tobacco liquid in the liquid storage chamber; detecting an amount of the tobacco liquid in the liquid storage chamber via the capacitive transducer. When the detected amount of the tobacco liquid reaches a preset value, the electronic cigarette emits alert information or cuts off the electricity.

8 Claims, 3 Drawing Sheets

(51) Int. Cl.
*A24F 25/00* (2006.01)
*A24F 47/00* (2020.01)
*H05B 1/02* (2006.01)

(58) Field of Classification Search
USPC ..... 131/328, 329
See application file for complete search history.

(56) References Cited

U.S. PATENT DOCUMENTS

| | | | | |
|---|---|---|---|---|
| 2017/0231277 | A1* | 8/2017 | Mironov | G01N 27/06 392/404 |
| 2017/0231278 | A1* | 8/2017 | Mironov | G01F 23/26 392/390 |
| 2018/0177238 | A1* | 6/2018 | Bessant | G01F 23/263 |
| 2018/0242644 | A1* | 8/2018 | Bessant | H05B 3/20 |
| 2018/0289907 | A1* | 10/2018 | Marmur | A61M 15/0003 |

FOREIGN PATENT DOCUMENTS

| | | | |
|---|---|---|---|
| WO | 20160183724 | A1 | 11/2016 |
| WO | 20170045897 | A1 | 3/2017 |
| WO | 20180114849 | A1 | 6/2018 |
| WO | 20180158081 | A1 | 9/2018 |

* cited by examiner

ELECTRONIC CIGARETTE AND USING METHOD TO ACCURATELY DETERMINE AN AMOUNT OF A TOBACCO LIQUID IN A LIUID STORAGE CHAMBER

TECHNICAL FIELD

The present disclosure relates to the field of electronic cigarettes, and in particular, to an electronic cigarette and using method thereof.

BACKGROUND ART

As a substitute of traditional cigarettes, electronic cigarettes are also named virtual cigarettes that are receiving more and more concerns and becoming more and more popular for they have advantages such as safety, no second-hand smoke, no open flames and no fire hazards in use. In the market, the electronic cigarette usually includes an atomizing unit and a power supply set, the atomizing unit includes an atomizing assembly, a heating element and a liquid storage chamber for storing the tobacco liquid; the heating element is capable of heating the tobacco liquid to generate an aerosol that flows out from an aerosol passage later, to simulate the effect of smoking real cigarette.

Inventors of the present application during a long time research find when the tobacco liquid in the liquid storage chamber runs out or is insufficient, the heating element won't shop heating so as to damage the atomizing assembly and generate lots of formaldehyde, endangering a user's health. In the prior art, determining whether overly burnt exists is realized by monitoring a temperature of the heating element. However, because of uneven temperature of the heating element, it is difficult to judge whether the tobacco liquid runs out, as a result, an effective way hasn't found to solve the problem that when the tobacco liquid in the electronic cigarette runs out or is insufficient the heating element is overly burnt.

SUMMARY

In view of the drawbacks in the electronic cigarette known to the inventors, to solve a problem that when the tobacco liquid in the electronic cigarette runs out or is insufficient the heating element is overly burnt, the present disclosure generally relates to an electronic cigarette and an using method thereof to accurately determine an amount of the tobacco liquid in the liquid storage chamber.

To overcome the above shortages, the present disclosure relates to an electronic cigarette including:

an atomizer, defining a liquid storage chamber formed therein;

a heating element, communicated with the liquid storage chamber;

a power supply, configured for supplying power;

a controlling unit, one end of the controlling unit electrically connected with the power supply, the other end thereof electrically connected with the heating element;

a capacitive transducer, electrically connected with the controlling unit, two electrodes of the capacitive transducer being disposed inside the liquid storage chamber for determining an amount of the tobacco liquid in the liquid storage chamber.

Further, the electrodes are made of any one of metallic wires, metallic pieces and metallic nets.

Further, the electrodes act as a part of the atomizer.

Further, the electrodes act as a part of the heating element.

Further, the electrodes are set opposite at top and bottom of the liquid storage chamber.

To solve the above problem, another technical scheme is referred in the present disclosure: a using method for the electronic cigarette. The electronic cigarette includes an atomizer, defining a liquid storage chamber formed therein; a heating element, communicated with the liquid storage chamber; a power supply, configured for supplying power; and a capacitive transducer, two electrodes of the capacitive transducer being disposed inside the liquid storage chamber. The using method includes: conducting the electricity and controlling the heating element to atomize the tobacco liquid in the liquid storage chamber; detecting an amount of the tobacco liquid in the liquid storage chamber via the capacitive transducer; when the detected amount of the tobacco liquid reaches a preset value, the electronic cigarette emits an alert information or cuts off the electricity.

Further, the electrodes are made of any one of metallic wires, metallic pieces and metallic nets.

Further, the electrodes act as a part of the heating element.

Further, the electrodes are set opposite at top and bottom of the liquid storage chamber.

Further, when the amount of the tobacco liquid reaches a first preset value, the electronic cigarette emits alert information; when the amount of the tobacco liquid reaches a second preset value, the electricity is cut off.

Compared to the prior art known to the inventors, the capacitive transducer is utilized to detect the amount of the tobacco liquid in the liquid storage chamber with a high reliability. When detected tobacco liquid reaches a preset value, the electronic cigarette emits the alert information or cuts off the electricity, to solve a problem that when the tobacco liquid in the electronic cigarette runs out or is insufficient the heating element is overly burnt.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
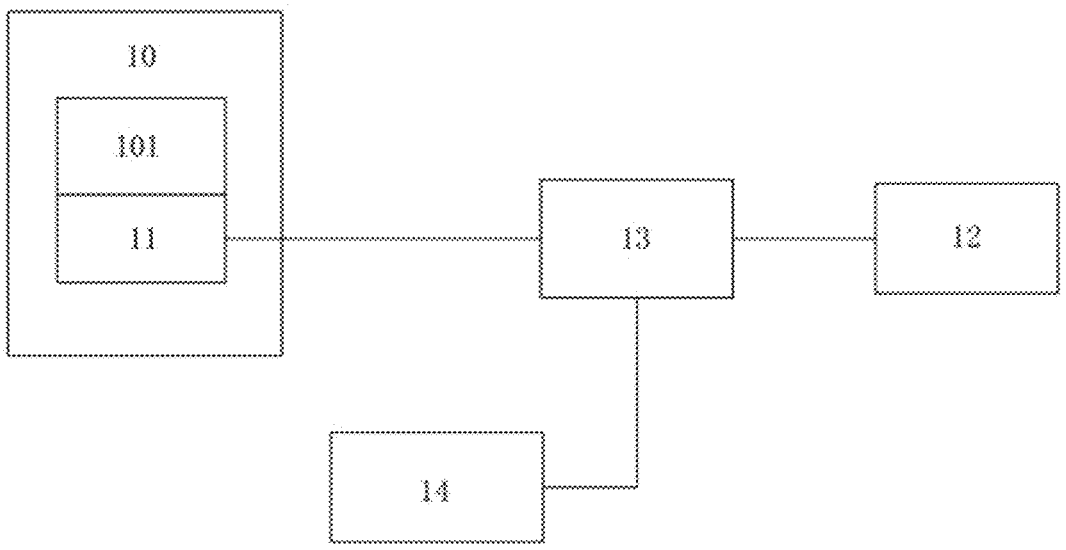
FIG. 1 is a block diagram of an electronic cigarette according to a first embodiment of the present disclosure.

Referring to FIG. 1, which is a block diagram of an electronic cigarette according to an embodiment of the present disclosure, the electronic cigarette includes: an atomizer 10, a heating element 11, a power supply 12, a controlling unit 13 and a capacitive transducer 14, one end of the controlling unit 13 is electrically connected with the power supply 12, the other end thereof is electrically connected with the heating element 11. The power supply 12 is configured for supplying power; the controlling unit 13 is configured for controlling the heating element 11 to generate heat. The capacitive transducer 14 is electrically connected with the controlling unit 13. The electrodes of the capacitive transducer 14 are disposed in the liquid storage chamber 101 for detecting an amount of the tobacco liquid. When detected amount of the tobacco liquid reaches a first preset valve, the controlling unit 13 emits alert information to remind users that the tobacco liquid is insufficient and needs to add tobacco liquid in time. When the amount of the tobacco liquid reaches a second preset valve, the controlling unit 13 cuts off the electricity and the heating element 12 stops generating heat, effectively solving a problem that when the tobacco liquid in the electronic cigarette runs out or is insufficient the heating element is overly burnt. In some embodiments, the alert information is a light-emitting diode (LED) flashing red light or a buzzing sound etc. as a signal.

Figure 2:
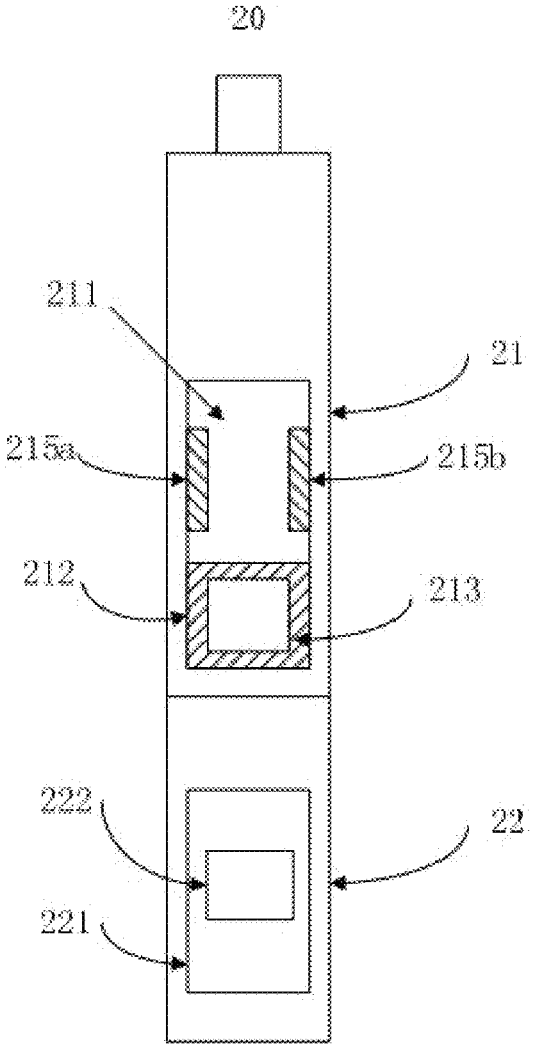
FIG. 2 is a block diagram of an electronic cigarette according to a second embodiment of the present disclosure.

Referring to FIG. 2, which is a block diagram of an electronic cigarette according to a second embodiment. The electronic cigarette 20 includes an atomizer 21 for atomizing tobacco liquid and a power supply 22. The atomizer 21 defines a liquid storage chamber 211 formed therein. The atomizer 21 has an atomizing core 212, surrounded by a heating element 213 (e.g. a heating wire etc.) and an absorbing cotton; the liquid storage chamber 211 is communicated with the heating element 213, the tobacco liquid in the liquid storage chamber 211 may be absorbed by the absorbing cotton to the heating element for heating. During work, the power supply 22 is conducted and the heating element 213 generates heat, so that the tobacco liquid is heated to generate an aerosol that is expelled via an aerosol passage, which may simulate an effect of smoking real cigarettes. In the embodiment, the power supply 22 is detachably connected with the atomizer 21, the power supply 22 has a power supply circuit 221 for supplying power. The electronic cigarette 20 further includes a controlling unit 222, an airflow sensor or a button is carried on the controlling unit 222 to control on/off states of the power supply 22.

In the embodiment, the atomizer 21 has a capacitive transducer that includes metallic electrodes 215*a* and 215*b* oppositely disposed on a side wall of the liquid storage chamber 211. The metallic electrodes 215*a* and 215*b* may be mounted on the side wall of the liquid storage chamber 211 or be integrally formed as a part of the liquid storage chamber 211. Since main ingredients of the tobacco liquid include original glycerine, fragrance, propylene glycol or nicotine and so on, which may act as an electrolyte to form a capacitance measuring system together with the metallic electrodes 215*a* and 215*b*, for detecting the amount of the tobacco liquid in the liquid storage chamber 211. When the tobacco liquid in the liquid storage chamber 211 is decreased, the amount of the electrolyte is changed, a dielectric constant of the electrolyte is changed, the capacitance value is changed accordingly. Therefore, by detecting the changing capacitance value between two metallic electrodes the amount of the tobacco liquid in the liquid storage chamber may be accurately determined. When the amount of the tobacco liquid reaches a preset value, the measuring system may send out the alert information or cut off the electricity supplied.

In some variations, the electrodes of the capacitive transducer are made of any one of metallic pieces, metallic wires or metallic nets. The electrodes of the capacitive transducer may be made of metallic materials in any shapes or sizes, without any limitations herein.

In some variations, the electrodes are integrally formed a part of the atomizer, that is, a metallic pipe, a metallic outer wall or a metallic sleeve of the atomizer. In some embodiments, by using any metallic part of the atomizer together with the tobacco liquid may form a capacity, adding a capacitance measuring circuit on a controlling board detects the capacitance of the capacity in real-time, as a result, the amount of the tobacco liquid in the liquid storage chamber is detected.

In some variations, the electrodes acts as a part of the heating element, that is, a heating wire, or a heating irony net etc.

In some variations, the electrodes are set opposite at top and bottom of the liquid storage chamber.

When the amount of the tobacco liquid in the liquid storage chamber 211 reaches a preset value, the controlling unit 222 emits an alert information or cuts off the electricity to prevent the heating element 213 from overly burnt due to lack of tobacco liquid. In some embodiments, a plurality of preset values may be set, when the amount of the tobacco liquid reaches a first preset value, the controlling unit 222 emits an alert information to remind a user that the tobacco liquid is insufficient and should be added in time; when the amount of the tobacco liquid reaches a second preset value, the controlling unit 222 cuts off the electricity and the heating element 213 stops heating, which may effectively solve the problem that when the tobacco liquid in the electronic cigarette runs out or is insufficient the heating element is overly burnt. In some embodiments, the alert information is an LED flashing red light or a buzzing sound etc. as a signal.

Figure 3:
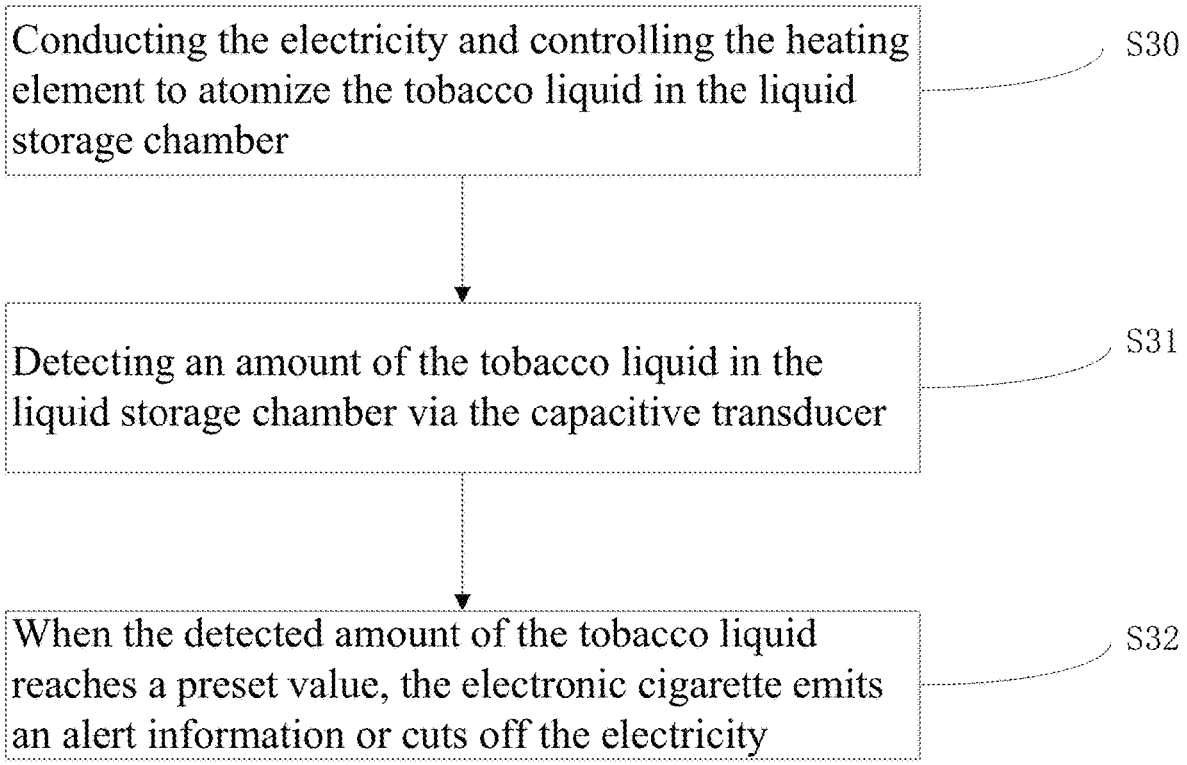
FIG. 3 is a flowchart of a using method for the electronic cigarette.

As shown in FIG. 3, which is a flowchart of a using method for the electronic cigarette, including:

S30, conducting the electricity and controlling the heating element to atomize the tobacco liquid in the liquid storage chamber;

S31, detecting an amount of the tobacco liquid in the liquid storage chamber via the capacitive transducer; S32, when the detected amount of the tobacco liquid reaches a preset value, the electronic cigarette emits an alert information or cuts off the electricity.

In some variations, the electrodes are made of any one of metallic wires, metallic pieces or metallic nets.

In some variations, the electrodes act as a part of the heating element.

In some variations, the electrodes are set opposite at top and bottom of the liquid storage chamber.

Further, the method includes: when the amount of the tobacco liquid reaches a first preset value, the electronic cigarette emits the alert information; when the amount of the tobacco liquid reaches a second preset value, the electricity is cut off.

The electronic cigarette and the using method thereof can accurately detect the amount of the tobacco liquid in the liquid storage chamber, to effectively solve a problem that when the tobacco liquid in the electronic cigarette runs out or is insufficient the heating element is overly burnt.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An electronic cigarette comprising:

an atomizer, defining a liquid storage chamber formed therein;

a heating element, communicated with the liquid storage chamber;

a power supply, configured for supplying power;

a controlling unit, one end of the controlling unit electrically connected with the power supply, the other end thereof electrically connected with the heating element; and a capacitive transducer electrically connected with the controlling unit, wherein two electrodes of the capacitive transducer are disposed inside the liquid storage chamber for determining an amount of the tobacco liquid in the liquid storage chamber, wherein the electrodes act as a part of the heating element.

2. The electronic cigarette according to claim 1, wherein the electrodes are made of any one of metallic wires, metallic pieces and metallic nets.

3. The electronic cigarette according to claim 1, wherein the electrodes act as a part of the atomizer.

4. The electronic cigarette according to claim 1, wherein the electrodes are set opposite at top and bottom of the liquid storage chamber.

5. A using method for an electronic cigarette, the electronic cigarette comprising an atomizer, defining a liquid storage chamber formed therein; a heating element, communicated with the liquid storage chamber; a power supply, configured for supplying power; and a capacitive transducer with two electrodes thereof disposed inside the liquid storage chamber;

wherein, the using method comprises:

conducting the electricity and controlling the heating element to atomize the tobacco liquid in the liquid storage chamber;

detecting an amount of the tobacco liquid in the liquid storage chamber via the capacitive transducer;

when the detected amount of the tobacco liquid reaches a preset value, the electronic cigarette emits an alert information or cuts off the electricity;

wherein the electrodes act as a part of the heating element.

6. The using method according to claim 5, wherein the electrodes are made of any one of metallic wires, metallic pieces and metallic nets.

7. The using method according to claim 5, wherein the electrodes are set opposite at top and bottom of the liquid storage chamber.

8. The using method according to claim 5, wherein when the detected amount of the tobacco liquid reaches a first preset value, the electronic cigarette emits the alert information; when the detected amount of the tobacco liquid reaches a second preset value, the electricity is cut off.

* * * * *